US006021644A

United States Patent [19]

Ares et al.

[11] Patent Number: 6,021,644

[45] Date of Patent: Feb. 8, 2000

[54] FROSTING HEAT-PUMP DEHUMIDIFIER WITH IMPROVED DEFROST

[76] Inventors: Roland Ares, 1004 Wedgewood, St. Charles, Mo. 63303; Nes Lakdawala, 119 De Touraine St., Lambert, Quebec, Canada, H9S 4S6

[21] Appl. No.: 09/136,096

[22] Filed: Aug. 18, 1998

[51] Int. Cl.[7] ..... F25D 21/06

[52] U.S. Cl. ..... 62/151; 62/156; 62/140; 62/278; 62/93

[58] Field of Search ..... 62/151, 155, 156, 62/140, 80, 81, 277, 278, 180, 157, 158, 234, 93, 97

[56] References Cited

U.S. PATENT DOCUMENTS

| | | | |
|---|---|---|---|
| 2,481,348 | 9/1949 | Ringquist et al. . | |
| 2,968,167 | 1/1961 | Raney | 62/278 X |
| 3,529,436 | 9/1970 | Brennan . | |
| 3,572,052 | 3/1971 | Toth . | |
| 4,178,767 | 12/1979 | Shaw | 62/155 |
| 4,917,174 | 4/1990 | Ring | 236/13 X |
| 4,928,498 | 5/1990 | Gossler . | |
| 5,890,368 | 4/1999 | Lakdawala | 62/278 X |

*Primary Examiner*—Harry B. Tanner
*Attorney, Agent, or Firm*—Daniel Kramer

[57] ABSTRACT

A reverse cycle refrigeration apparatus for air dehumidification is employed having an evaporator and a condenser and employing first and a second heat transfer coils for this purpose. Both coils are positioned in the air stream. In a first cycle the second coil functions as the evaporator for cooling and dehumidifying the air stream and accumulating frost and the first coil acts as the condenser, warming the cooled and dehumidified air stream and thawing frost having accumulated on it. In a second cycle the first coil acts as the evaporator, cooling and dehumidifying the air and providing the heat for defrost and the second coil acts as the condenser, thereby being defrosted. Dampers are provided for stopping air flow over the defrosting coil.

11 Claims, 4 Drawing Sheets

FROSTING HEAT-PUMP DEHUMIDIFIER WITH IMPROVED DEFROST

BACKGROUND

Heat pumps or reverse cycle refrigerating systems having two coils for interchangeably acting as the evaporator and the condenser are old in the art. So is the use of such systems for cooling and dehumidifying air and accumulating frost on one cycle, and for defrosting the frost on a second cycle. It is also believed to be old to position both coils in the same air stream, thereby securing the desired cooling and humidifying effect from one coil acting as the evaporator while simultaneously warming and "reheating" the airstream from the heat discharged from the other coil acting as the condenser.

When the dehumidifier is used to dehumidify a cold environment. That is, when the dehumidifier is employed to dehumidify air where the desired temperature of the dehumidified environment and the source of air entering the dehumidifier, is 55 F. or less, the temperature of the refrigerant in the cooling/dehumidifying coil will be less than 32 F., the freezing point of water. Such conditions are common in indoor ice skating rinks and similar environments.

Under these operating conditions, water condensed from the air as a necessary function of the dehumidifying process, collects on the cooling/dehumidifying coil in the form of frost. This frost accumulates on surfaces of the fins and tubes of the cooling/dehumidifying coil, the evaporator.

As the frost accumulates on the coil fins and tubes, it gradually reduces the coil area available for air flow, thereby reducing the flow of air through the coil and increasing the fan motor power. In addition the frost accumulation acts as insulation between the air-to-be-dehumidified and the tubes and fins of the coil. This makes the coil a much less effective heat transfer device and gradually reduces the dehumidification effect of the evaporator coil as the air flow over the coil becomes increasingly restricted.

The evaporator coil, having accumulated a quantity of frost deemed to be excessive, must therefore be defrosted so that it, after the defrost, can continue to operate efficiently, that is, with the high, unrestricted original air flow and with the high original heat transfer capacity, un-reduced by any insulating frost formation.

Newer, unobvious technology, described in co-pending patent application having Ser. No. 08/855,441 and titled "Improved Dehumidifier", discloses the use of a damper allowing and preventing air flow over the one coil which acts as the cooling and dehumidifying coil, whereby air is allowed to flow over the coil while it is refrigerating and dehumidifying, and prevented from flowing over the coil while it is heating and defrosting. With the air flow over the defrosting coil stopped, moisture rising from the warmed coil during defrosting is prevented from being carried away in the air stream which would, at least in part, defeat the total dehumidifying effort.

While the above described system is perfectly workable and achieves its objective, improvements are possible. This invention is intended to describe the improvements, and the benefits which arise from their use.

FIELD OF THE INVENTION

This invention is directed to the construction and the method of use of reverse cycle compression type refrigerating systems. This type system is employed in dehumidifying and frosting apparatus for providing a continuous supply of dehumidified air, while providing the multiple benefits of: minimizing the frequency of defrost, avoiding damaging floodback of liquid refrigerant to the compressor on cycle change, on one hand, and preventing moisture from the defrosting (former) dehumidifying coil from being carried into the air stream, which would undo in part its prior dehumidifying effect on the other. Additional important advantages accruing from the unobvious design will become apparent as the invention and its mode of operation is described more fully in the ensuing paragraphs.

PRIOR ART

In order to best acquaint the public with known prior art, reference is made to U.S. Pat. Nos. 2,481,348 to Rinquist et. al.; 3,529,436 to Brennan, 3,572,052 to Toth and 4,928,498 to Gossler. These were the patents cited by the examiner in U.S. Pat. No. 08/855,441 referred to above.

Referring now to FIG. 1 there is shown a reverse cycle dehumidifier for dehumidifying a space have an air-handling unit 20 having a conditioning area defined by the positions of the coils 24 and 38. Within the conditioning area of the unit an evaporator coil 38 and a condenser coil 24 are located. An air mover, such as a fan 22 in the unit, draws air 54 from a room or other source, through the unit 20 and the conditioning coils 24 ans 38. Part of the air 54B is drawn through the evaporator 38 where the cold refrigerant within the evaporator causes moisture to condense from the air onto the tubes 27 and finned surfaces of the evaporator; This condensation removes moisture from the air 54B, thereby reducing both its temperature and its humidity. Where the temperature of the refrigerant evaporating in the evaporator is higher than 32 F., the freezing point of water, the moisture removed by the evaporator drips from the evaporator into a drain pan 39 located under the evaporator 38.

The remainder of the fan-drawn air or air stream 54A is drawn through the condenser 24 which heats that air-portion 54A. This heated air, having traversed and exited from condenser coil 24 is mixed with the cooler dehumidified air which had traversed and exited from coil 38, to reheat that dehumidified portion of the air. The recombined air streams, having traversed the two coils and been cooled, dehumidified and them warmed are mixed and pressurized within blower 22 and delivered by ducts or louvers to the space where the warmed dry air is desired. The temperature of the dry airstream 56 is slightly warmer that the temperature of the moist entering air 54A/B. Applications for this type of equipment might be indoor swimming pools, exercise rooms or other areas where low humidity but normal temperatures are desired, but with reduced humidity.

A compressor-driven refrigeration cycle circulates refrigerant through the condenser and the evaporator in sequence to produce this dehumidification and reheat effect.

Described in greater detail, the refrigerant leaves the compressor 48 as a hot gas and at high pressure and first via compressor discharge 50 through reversing valve 48 to the condenser 24 via discharge line 42 and condenser inlet manifold 28. In the condenser 24 the hot refrigerant vapor is cooled and condensed to a liquid, simultaneously rejecting the refrigerant's heat of condensation to the condenser coil 24 whereby both the condenser coil itself and the air portion 54A passing over it are heated.

The liquid refrigerant from the condenser then passes through circuit tube 30 through distributor 28 and through restrictor 32 to the evaporator 38 via distributor 34 and circuit tubes 36. In the restrictor 32 the refrigerant pressure and temperature are reduced. In the evaporator 38 the cold refrigerant cools the portion 54B of the air passing over the evaporator and evaporates to a refrigerant vapor within the evaporator tubes. The refrigerant vapor is then drawn back to the compressor via suction line 44, reversing valve 46 and suction connection 52 to repeat the cycle.

In certain applications, such as those where the air to be dehumidified is itself cold, the temperature of the refrigerant within the evaporator must be colder than 32 F. In these applications at least some of the water condensed from the air by the evaporator 38 will not flow into the drain pan 39 but will freeze on the tubes and fins of the evaporator coil 38. Over a period of time an increasing amount of water, in the form of frost or ice, will freeze on the evaporator coil 38. This accumulation of frost will cause the flow of air 54B through the evaporator coil to be restricted or impeded and the air flow reduced. This flow reduction will have the dual effect of reducing the dehumidifying effect of the evaporator and increasing the relative amount of air 54A drawn through the condenser.

Where the air being dehumidified is above 32 F., simply stopping the compressor 48, while allowing fan 22 to continue to run, allows the evaporator to be warmed and the frost to be thawed by the air stream. However, this defrost process, though low cost, takes a long time, causes evaporation of some of the meltage into the air stream 54B. This causes a harmful and undesired reversal of the dehumidification process.

Simply reversing the cycle of the system by reversing the internal port connections of reversing valve 46 causes the functions of the evaporator 38 and condenser 24 to be reversed. The evaporator 38 now receives hot gas from the compressor via compressor discharge 50, reversing valve 46 conduit 44 (formerly called suction line) and inlet manifold 40. The evaporator 38 is warmed by the hot gas and the frost is quickly thawed. Most of the moisture flows into the drain pan 39. However, with the normal airflow continuing, it was found that a substantial part of the frost on the thawing evaporator 38 now evaporated and in the form of water vapor was conveyed to the area intended to be dehumidified, again defeating the whole intent of the dehumidification process and requiring the dehumidifying apparatus to operate longer than would have been required with a properly designed system.

Therefore more modern processes caused the air moving device 22 to shut off during defrost. Under these conditions there was no air flow either through the frosted, now defrosting, evaporator 38 or the former condenser 24 now called on to evaporate the liquid refrigerant fed to it by the defrosting evaporator 38. While the stopped air flow had the useful effect of limiting wasteful transfer of water vapor re-evaporated from the thawing frost back to the area being supplied with dry air, the lack of airflow over the former condenser 24 reduced its capacity as an evaporator so much that unevaporated liquid refrigerant was able to return from it to the compressor, either in a steady stream or in "slugs". The liquid refrigerant, if arriving at the compressor in a slug, damaged the compressor by breaking the valves, pistons or rods. If the liquid refrigerant arrived at the compressor in a stream it diluted the oil and caused excess bearing and cylinder wear and early compressor failure. Further, the slow evaporation of liquid refrigerant in the "evaporator" 24 unnecessarily extended the time required for defrost, thereby allowing fewer hours of effective dehumidification during which the equipment could perform its function and, in some cases, requiring the installation of larger or auxiliary equipment to do the desired dehumidification task.

In summary therefore, it can be seen that the traditional step of stopping the air moving means during defrost caused a number of undesirable results, including degrading the life and reliability of the system as well as the system capacity, its dehumidifying effect, and energy efficiency of the system.

OBJECTS AND BENEFITS

Therefore this invention has the following objects and provided the following benefits:

This invention is directed toward the apparatus and the process by which both the steady flow of liquid refrigerant to the compressor and the return to the compressor of liquid refrigerant slugs during the course of or immediately following the defrost is eliminated or substantially reduced and by which defrosts occur with speed and with minimum or no transfer of defrost vapor into the dehumidified space or discharge airstream.

It is directed toward the objective of providing a dehumidifier employing a reverse cycle compression type refrigeration system with a novel, as well as an improved means for defrosting its frosted evaporator that is quick, efficient, safe, and damage-free to the compressor, as well as allowing substantially continuous dehumidification.

SUMMARY OF THE INVENTION

A method of defrosting the evaporator of a dehumidifier for an air stream employing a reverse cycle compression type refrigeration system having a condenser coil and an evaporator coil operated in frosting mode, both positioned in the air stream, with valve means for reversing their functions. A damper for allowing and preventing flow of air over the evaporator coil and an air bypass with bypass damper for allowing the flow of air bypassing both the evaporator and the condenser and for preventing the bypassing airflow.

The method comprises the steps of:

Closing the damper to stop air flow over the evaporator while allowing airflow over the condenser;

Reversing the cycle, thereby causing the frosted evaporator to act as the condenser and the condenser to act as the evaporator.

Opening the bypass damper to allow a portion of the airstream to bypass both the evaporator and the condenser thereby reducing the quantity of air flowing through the acting evaporator;

And determining the time required for defrosting the evaporator and continuing the defrost for a predetermined period longer than that time, whereby the quantity of refrigerant in the defrosting evaporator is reduced, thereby reducing or eliminating floodback of liquid refrigerant to the compressor on reversing the refrigerating cycle to restore the original operating condition.

DETAILED DESCRIPTION OF THE INVENTION

Figure 1:
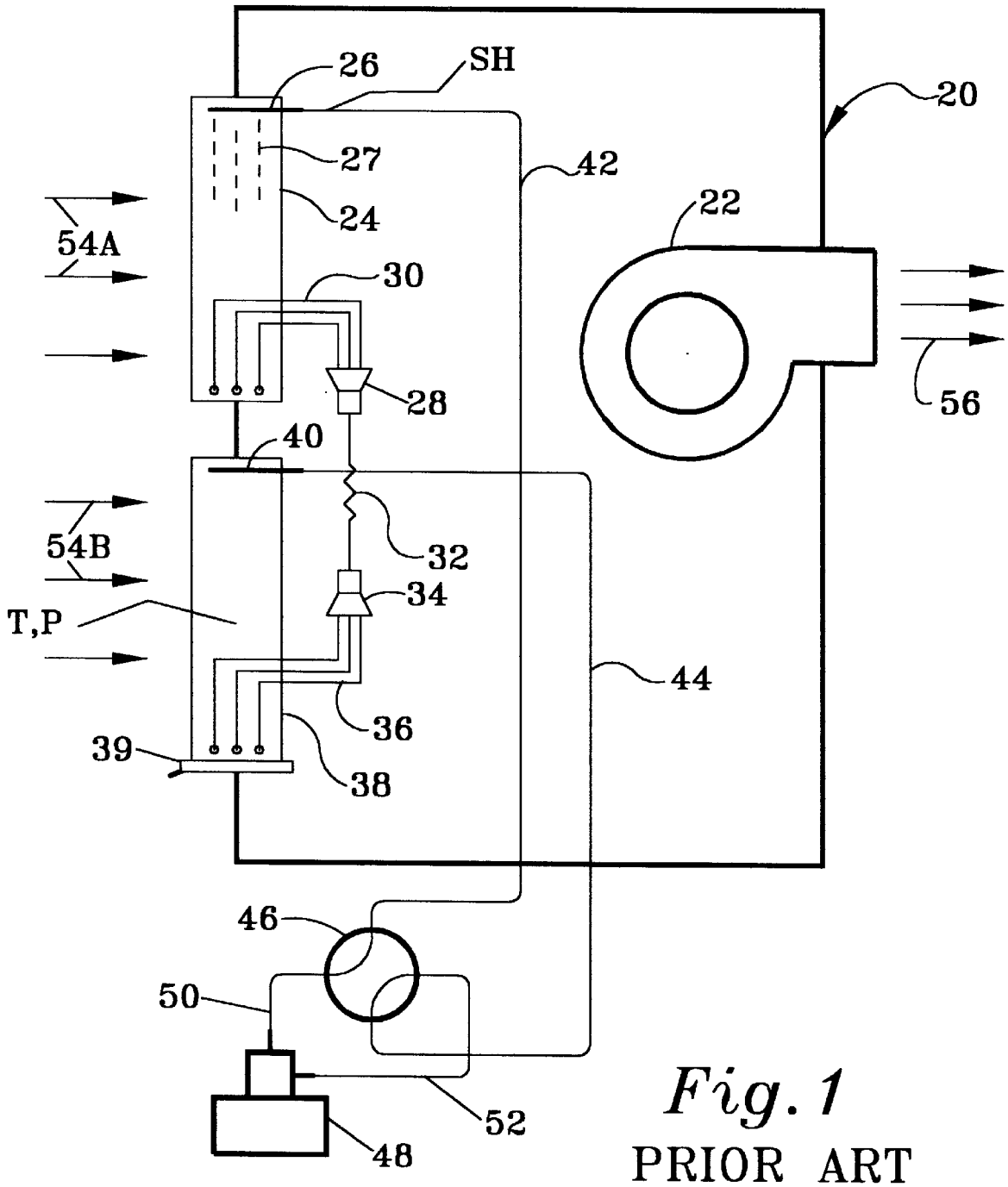
Fig. 1 PRIOR ART
FIG. 1 is a schematic piping and air flow arrangement of prior art construction. The refrigerant piping arrangement shown here and the applicable numeral identification will apply, though not be shown, in the other figures.
Figure 2A:
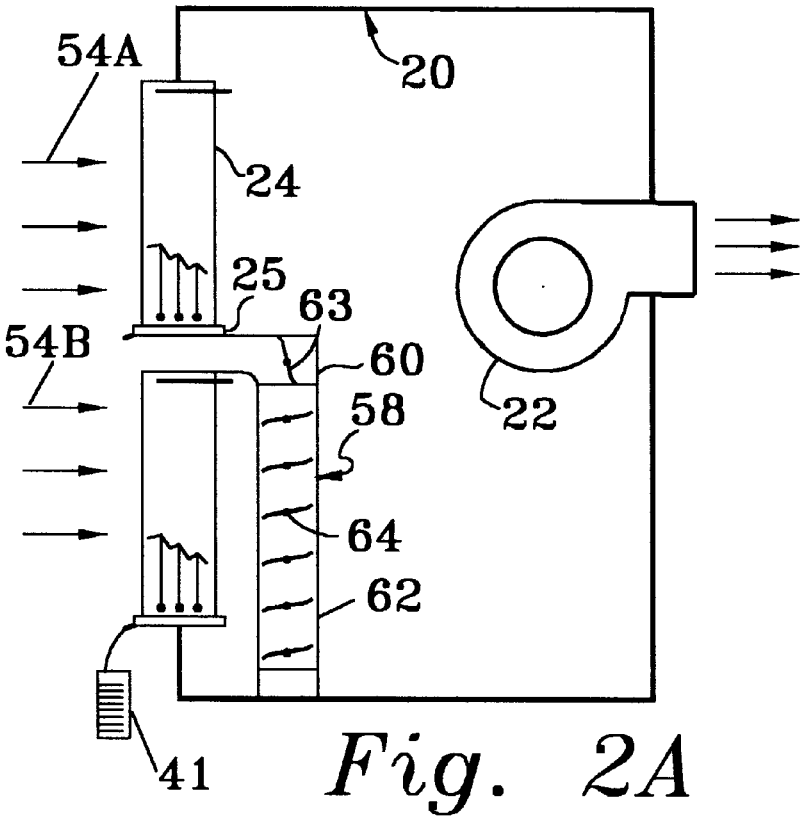
FIGS. 2A and 2B show apparatus of the invention illustrating alternate means for controlling the airflow through the non-defrosting coil during defrost of the lower coil. The refrigerant piping of FIG. 1 applies.
Figure 2B:
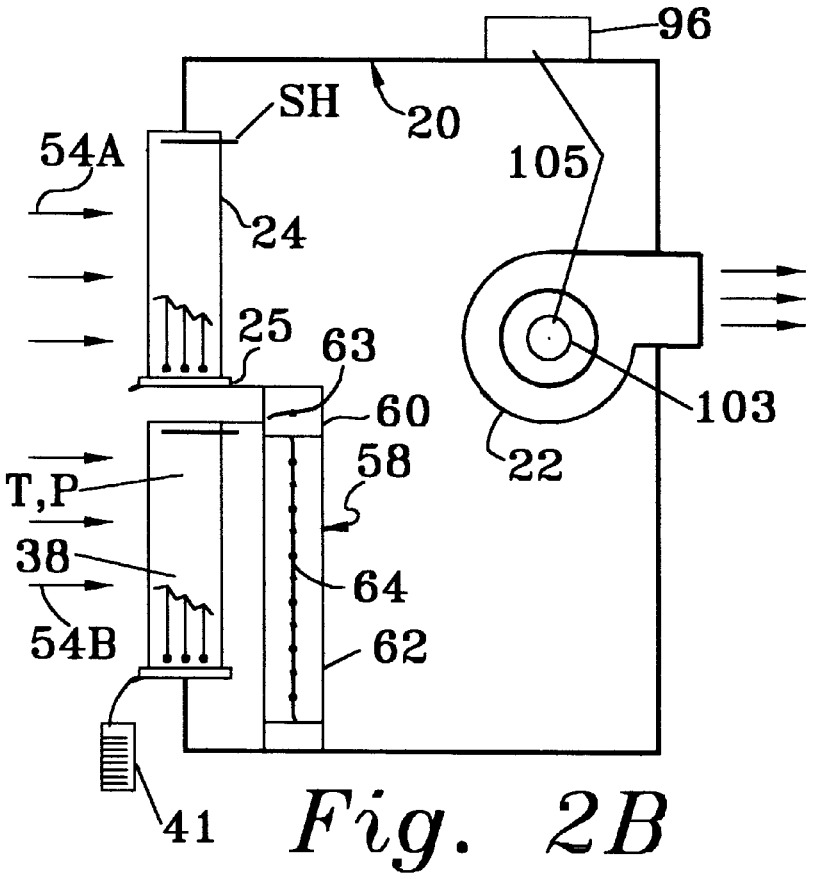

Referring now to FIGS. 2A and 2B, the reverse cycle refrigerating system including compressor 48, reversing valve 46 and the pipes associated with their connection to coils 24 and 38 have been omitted. However, the presence and connection of these components to the coils 24 and 38 in FIGS. 2A, 2B, 3A and 3B is exactly the same as shown in FIGS. 1 and 4. In FIGS. 2A and 2B, in accordance with the present invention, there is provided a duct-like unit 20 having a first coil 24 and a second coil 38 connected to a reverse cycle compression type refrigeration system as shown and described in FIG. 1. Coil 24 is provided with drain pan 25 and coil 38 with drain pan 39. The drain pans may be common. A fan 22 is provided which draws air 54 over both coils. A portion 54A of the total airflow flows over the first coil 24 and the remainder 54B flows over the second coil. A damper 64 is provided to allow or prevent the flow of air over coil 38. Damper 64 is installed in casing 62. An optional additional damper, bypass damper 63, is positioned between coils 24 and 38, which coils are installed in casing 60. The combined damper-casing structure is identified as 58. The system includes reversing valve means 46 as shown in FIG. 1 for providing a first cycle and a second cycle.

During the initial condition or first cycle illustrated in FIG. 2A where the face damper 64 is open and the air bypass damper 63 is closed, hot compressor refrigerant vapor from the compressor is directed into the first coil 24, now acting as a condenser. The refrigerant vapor is condensed to a liquid in first coil 24, at the same time heating the air 54A flowing through it. The liquid refrigerant flows through a restrictor, where its pressure and temperature are reduced, and into the second coil 38, as shown in FIG. 1. The cold liquid refrigerant in the second coil 38 cools and condenses moisture from the air 54B flowing through it, thereby dehumidifying the air. Because the system is applied to dehumidifying a lower temperature environment, such as that existing in ice skating rinks and in and round open display cases in supermarkets, the temperature of the refrigerant liquid evaporating in coil 38 is colder than 32 F. Therefore the condensed moisture deposits on the second coil 38 as frost where it gradually accumulates. The frost accumulates until a timer or sensors, to be described, initiate a defrost.

At that time, during the period when defrost is initiated, the dampers assume the positions shown in FIG. 2B where damper 64 is closed, preventing flow of air over defrosting evaporator 38.

In accordance with a first preferred version of the invention, the defrost cycle for evaporator coil 38 employs the following steps:

The fan 22 continues operation.

The damper 64 positioned to allow and prevent air flow over coil 38 is closed, thereby stopping the flow of air through the second coil, while fan 22 continues to operate.

The reversing valve 46 (FIG. 1) is reversed sending hot compressed gas into the frosted coil 38, thereby warming and defrosting it.

The temperature or pressure (T,P) of the defrosting coil 38 or the flow rate of meltage from the drain pan of the second coil are sensed.

On a preset condition of these system conditions, indicating the defrost is complete and that excess refrigerant has been transferred from the defrosting second coil to the first coil, the cycle, via reversing valve 46, is again reversed and the damper 64 is opened, thereby restoring the system to its initial condition of operation during which dehumidification of the air by the second coil is continued.

In a second preferred version of the invention the defrost process employs the following steps:

The fan 22 continues operation;

The damper 64 is closed, thereby stopping the flow of air 54B through the second coil 38; Damper 63 is opened, thereby reducing the quantity of air flowing through first coil 24;

The reversing valve 46 (FIG. 1) is reversed sending hot compressed gas into the second coil 38, thereby warming and defrosting it and causing the first coil 24 to act as condenser;

The temperature or pressure of the first coil 24 or second coil 38 or the flow rate of meltage 41 from the drain pan 39 of the second coil 38 are sensed.

On a preset condition of one of the above parameters, indicating the defrost of coil 38 is complete, the face damper 64 is opened, the bypass damper 63 is closed and the reversing valve is operated to restore the original coil functions.

In a variation of the above process, when a sensed parameter indicates that the defrost is complete, the defrost is not terminated but is continued for an additional period T to allow most of the refrigerant within the defrosting evaporator to be transferred to the acting evaporator, coil 24. The system reversal to a normal operating condition, including the reversal of reversing valve 46 (FIG. 1), the opening of damper 64 and the closing of damper 63, is performed on the sensing of an operating parameter of coil 24 such as temperature, pressure or suction superheat.

This time extension permits the pressure in defrosting evaporator 38 to rise and increase the pressure difference between it and the acting evaporator, coil 24. The suction superheat at the outlet of coil 24 will decrease as the defrost period continues because of the greater quantity of refrigerant pushed into coil 24 from defrosting coil 38. Note that the pressure rises rapidly within defrosting coil 38 because the cooling effect of the frost has ceased, the frost having been all melted, and the damper 64 being shut. Therefore, on cycle reversal, though the pressure in coil 38 will be higher, there will be less liquid within coil 38 and therefore less liquid is likely to be returned to the compressor as slugs or floodback on cycle reversal.

Figure 3A:
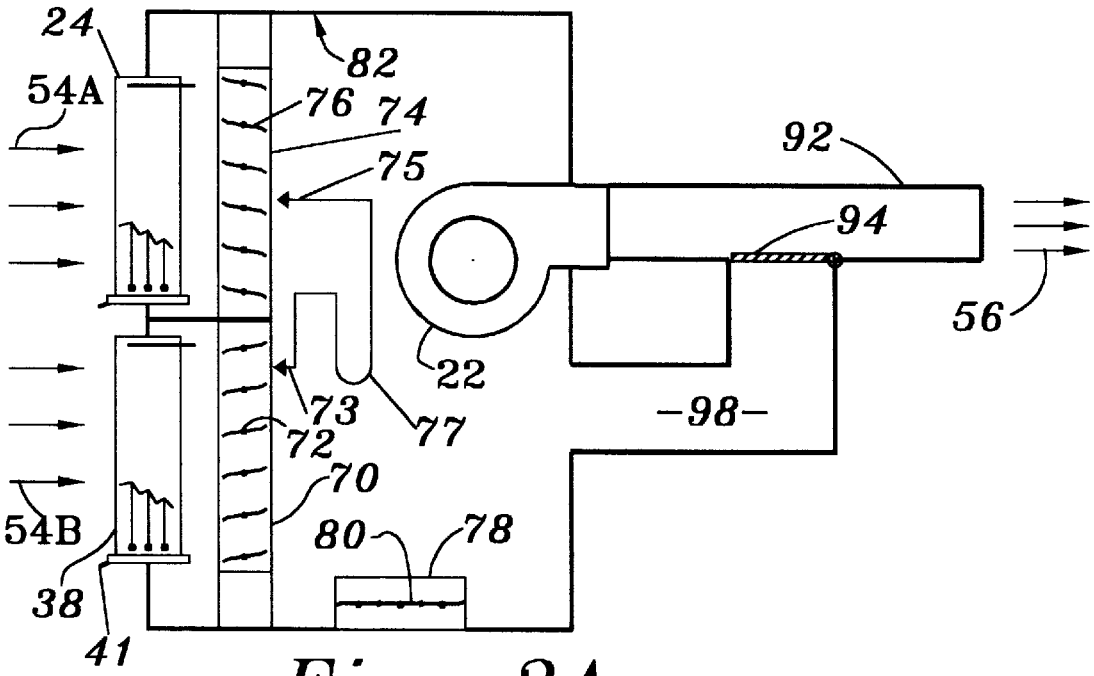
FIGS. 3A and 3B illustrate alternate dehumidifying/reheating and defrosting modes of either coil with airflow bypass during defrost including air-velocity differential means and condensate rate means for initiating defrost. The refrigerant piping of FIG. 1 applies.
Figure 3B:
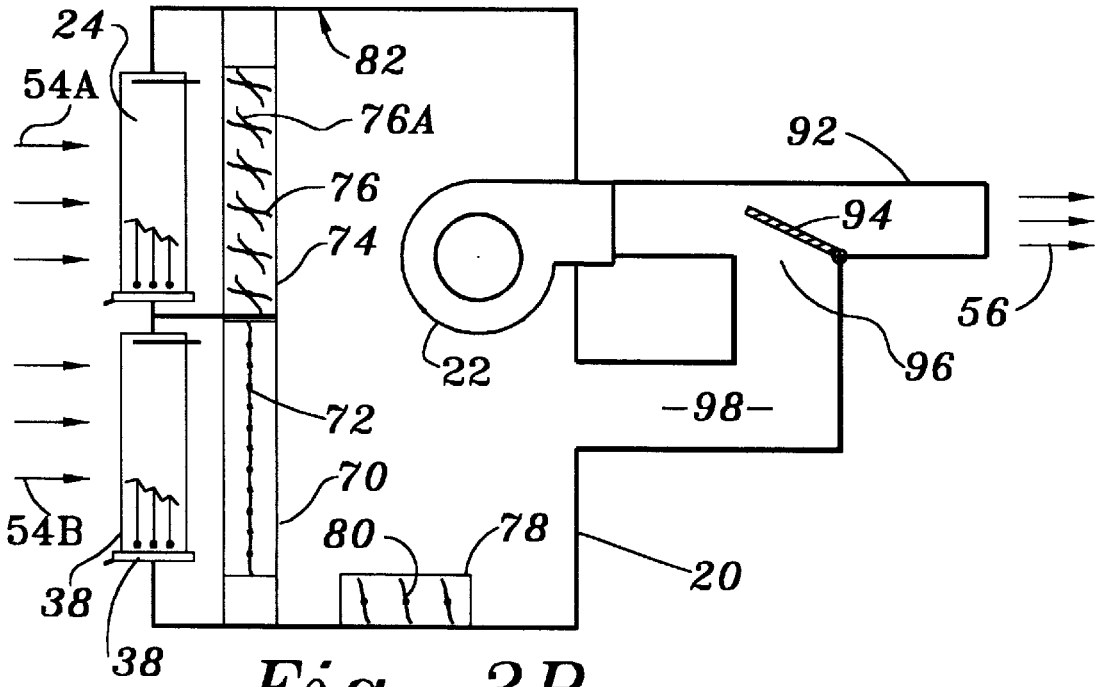
Figure 4:
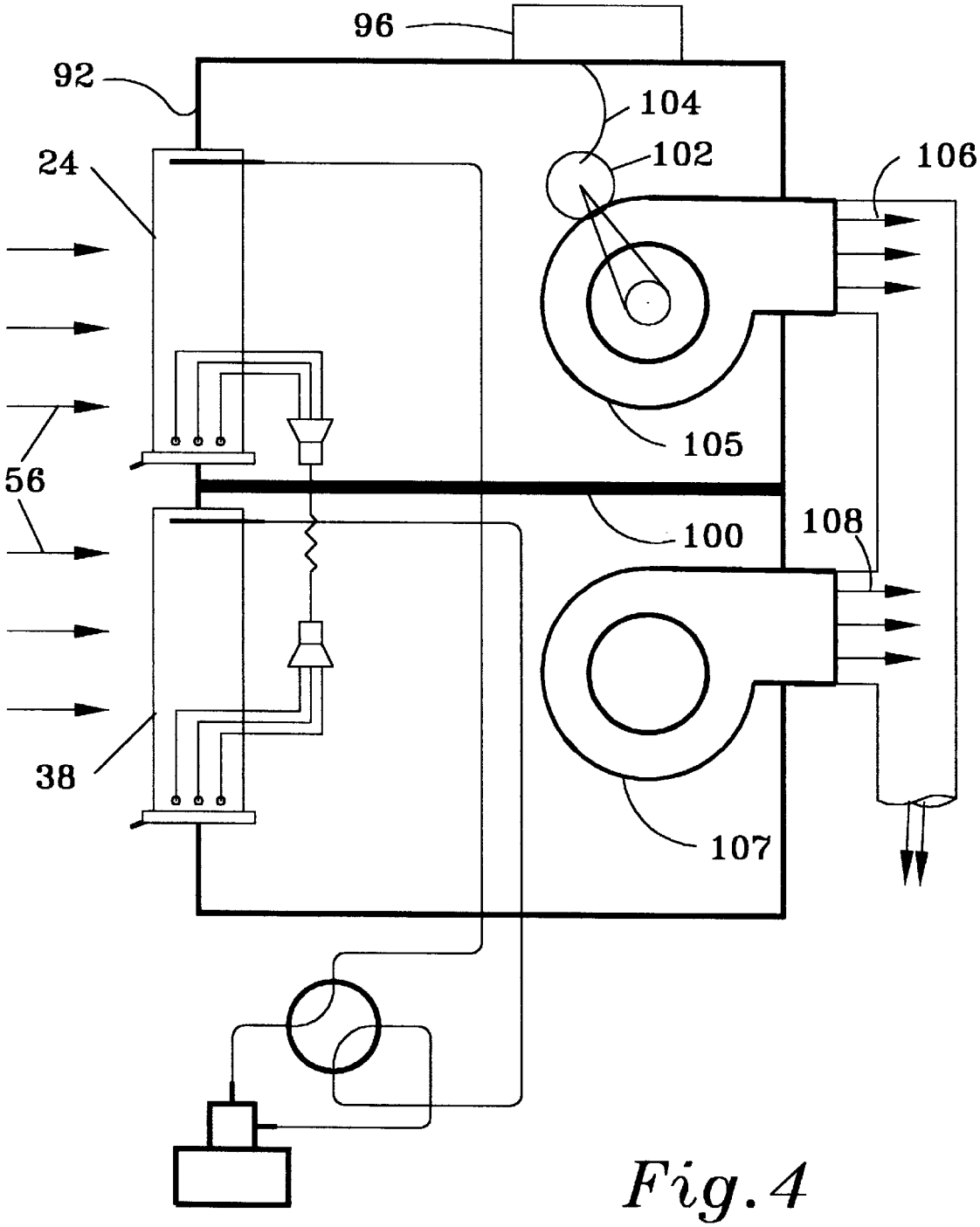
FIG. 4 shows a defrosting dehumidifier where dual fans are provided for air flow control during defrost.

Bypass damper 63, and its functional equivalents 80 shown in FIGS. 3A and 3B on the fan suction side and 94 shown on the fan discharge side, are provided for the purpose of opening and thereby reducing the airflow through the non-defrosting coil when it is acting, temporarily or permanently, as the system evaporator. The primary use of any of these bypass dampers would be during a coil defrost period when, for example, the damper 64 is closed to prevent air flow through the defrosting evaporator 38. The airflow reduction through the non-defrosting coil may be necessary since it will be acting as an evaporator and moisture condensation will be occurring on its surfaces. The higher than normal air velocity through it may cause the droplets of water condensed on its surfaces to spit-off or otherwise entrain into the discharge airstream, thereby reducing its effectiveness as a dehumidifier.

As an alternate to bypass dampers, fan speed control 96 acting to control the speed of the fan motor 103 is provided.

The fan speed control 96 is interconnected with the defrost control system to slow down fan motor 103 during those periods when damper 64 is closed so that the air velocity through the coil 24 will be reduced.

Referring now to FIG. 3B, there is disclosed a third preferred version of the invention. In this version, during the defrost cycle when the damper 72 of the defrosting coil 38 is closed, there is found to be excess air flowing through the non-defrosting coil 24. The damper 76 of the non-defrosting coil 24 is then partly closed to position 76A to reduce the air flowing through coil 24 and to restore the air flow through it to the initial flow rate.

Referring again to FIGS. 3A and 3B, there are shown coils 24 and 38, casing 82, face damper 76 for coil 24 mounted in damper casing 74 and face damper 72 for coil 38 mounted in damper casing 70. There is also shown condensate rate detector 41. Various sensors as described in connection with FIGS. 2A and 2B will also be considered applicable.

Bypass damper 80 installed in its casing 78 is shown for use where a constant volume discharge air stream 56 is desired. Fan discharge bypass damper 94 is shown with bypass duct 98 where reduced airflow through the non defrosting coil is desired together with a reduction in the volume of discharge airstream 56.

Coil 24 has drain pan 25 positioned under it. Coil 38 has drain pan 39 positioned under it. The reversible refrigeration system of FIG. 1 is applied.

During the first cycle, dampers 72 and 76 are open. Dampers 80 and 94 are closed. Coil 24 receives discharge gas from compressor 48 condenses it to a liquid and conveys it to coil 24 at lower pressure and temperature via restrictor 32. Coil 38 dehumidifies and collects frost on its surfaces until defrost is required. Then damper 72 is closed, reversing valve reverses causing discharge vapor from the compressor to be conveyed to coil 38, defrosting it. Air flow reduction means describes may be employed. Immediately after defrost is complete damper 72 is opened and airflow reduction measures are discontinued. No cycle reversal occurs at this time. Coil 38 continues to function as the condenser and coil 24 as the evaporator. Naturally, coil 24, during the course of its operation, performs dehumidification and the condensed water is deposited on its fins and tubes as frost. Eventually it will require defrosting under the same circumstances which applied to initiation of the defrost for coil 38. At that time damper 76 will be closed and reversing valve 46 activated to cause discharge gas to flow into coil 24, thereby defrosting it. When its defrost has been completed only damper 76 will be opened (and bypass dampers or other airflow reducing means reversed to restore full airflow.) At this condition the first cycle condition will have been restored. Refrigeration and dehumidification will continue exactly as described in connection with the first cycle.

This process allows substantially continuous dehumidification while reducing the number of cycle reversals by half over the single damper arrangement. Further, each cycle reversal entails reduced hazard to the compressor because the refrigerant liquid volume in the condenser, which on reversal can flow back to the compress, is minimum.

Referring now to FIG. 4 there is shown a coil and refrigeration circuit arrangement which is substantially identical to that of the prior figures. However, a separate fan/motor combination is shown for each coil. Coil 24 has fan 105, producing discharge airstream 106, with speed control 96 controlling motor 102 by connection 104. Coil 38 has fan 107, producing discharge airstream 108 with an independent motor, not shown.

The operation of the system, accumulation of frost on the cooling/dehumidification coil and defrost process is as described earlier. However, there being no dampers, the airflow through the defrosting evaporator is stopped simply by stopping its individual fan. Should the non-defrosting coil require reduced airflow this is achieved simply by slowing down the applicable fan motor. This dual fan arrangement can provide significant advantages over the single fan design since the correct airflow for each application, evaporating and condensing can be secured without any airstream restriction, thereby reducing fan power required for each function to the minimum, and minimizing the mechanical complexity of the apparatus.

DEFROST INITIATION

Referring to FIG. 3A, a differential air pressure switch, indicated for clarity as U-Tube manometer 77, is employed as a differential air velocity sensor. Though a manometer is shown, a diaphragm or other type differential sensor switch could be employed. Pitot 75, 73 are positioned to send the air impact or velocity pressure of coils 24, 38 respectively. Other air velocity characteristics can be employed for the purpose of establishing a characteristic of velocity difference. Among these are the cooling effect of the air velocity on an electrically heated resistor (Hukill Anemometer), or the effect of increased coil resistance and reduced air velocity on fan motor loading or the effect of frost and reduced air velocity on suction pressure. The trip or defrost initiating setting of the switch can be determined by test or experiment. That is, the system can be run under frosting conditions until external observation of the air velocity related parameters of both coils and their comparison indicates that a desirable condition for initiating defrost has been reached. At that condition the differential switch or other switch activating comparison system is simply adjusted to just begin defrost. Other methods of observing the air velocity or a characteristic thereof include observing the temperature drop of the air through the evaporator and the temperature rise of the air through the condenser.

This dual velocity arrangement is superior to a simple measurement of air velocity off the frosting coil because the effect of reduced air velocity off the frosting coil is magnified and augmented by the corresponding and resulting increase of air velocity off the non-defrosting coil when the air flow through the frosting coil is restricted. The combination of reduced air velocity on the one hand and concomitant increased velocity on the other inevitably provides increased sensitivity for the velocity characteristic difference method.

DEFROST TERMINATION

Tests have indicated that terminating defrost and reversing the cycle immediately after defrost is complete is hazardous to the compressor. This is because the liquid refrigerant which has collected in the defrosting evaporator during the course of the defrost has not had sufficient time or sufficient pressure difference to transfer that excess liquid refrigerant back into the non-defrosting coil, now the evaporator. Reversing the cycle under the condition of excess liquid in the defrosting coil results in a surge of the excess liquid refrigerant back to the compressor in the form of "slugs", thereby creating a high probability of compressor damage. The condition at which defrost should be terminated is best determined by monitoring the suction superheat of the non-defrosting coil. While there is still frost on the defrosting coil the pressure in it rises slowly, if at all, thereby limiting the available pressure differential for driving liquid refrigerant from the defrosting coil to the non-defrosting coil. This shortage of liquid refrigerant in the non-defrosting coil (accompanied by an excess amount of liquid refrigerant in the defrosting coil) causes the non-defrosting coil, performing as evaporator, to exhibit a high suction superheat.

When defrost is complete, the pressure in the defrosting coil rises rapidly, forcing most of the liquid residing in the defrosting coil into the non-defrosting coil and thereby causing the suction superheat in the non-defrosting coil to drop to normal. It is at this condition that reversing the cycle results in the smallest return of potentially hazardous liquid refrigerant to the compressor.

From the foregoing description, it can be seen that the present invention comprises an advanced dehumidification apparatus and process for operating same. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims, individual elements or steps and equivalents thereof.

We claim:

1. A dehumidification apparatus employing a reverse cycle compression type refrigeration system having an evaporator coil and a condenser coil, the coils being connected to exchangeably perform their functions, the apparatus including fan means for providing an airstream, the coils both being positioned in the airstream, the airstream having a first velocity through the evaporator coil, the evaporator air velocity being affected by frosting, and a second velocity through the condenser coil; means for defrosting the evaporator requiring defrosting including means for reversing the refrigeration cycle, thereby causing the frosted evaporator to function as a condenser and the condenser as an evaporator, and means for initiating defrosting including means for observing a characteristic of the air velocity through the frosting coil, means for observing a characteristic of the air velocity through the other coil, and means for comparing the two characteristics.

2. A dehumidification apparatus employing a reverse cycle compression type refrigeration system as recited in claim 1 further providing that at least one observed characteristic of the air velocity is the velocity pressure.

3. A dehumidification apparatus employing a reverse cycle compression type refrigeration system as recited in claim 1 further providing that at least one observed characteristic of the air velocity is the ohmic effect on a heated resistor.

4. A dehumidification apparatus employing a reverse cycle compression type refrigeration system as recited in claim 1 further providing means for terminating the defrost, including means for sensing when defrost is complete and means for delaying termination after defrost is complete until the satisfaction of a condition.

5. A dehumidification apparatus employing a reverse cycle compression type refrigeration system as recited in claim 4 further providing that the condition to be satisfied is selected from the group consisting of: attainment of specified suction superheat of the non-defrosting coil; elapse of set time; and attainment of a specified condensing temperature in defrosting coil.

6. A dehumidification apparatus employing a reverse cycle compression type refrigeration system having an evaporator coil and a condenser coil, the coils being connected to exchangeably perform their functions, said evaporator coil periodically requiring defrosting, the apparatus including fan means for providing an airstream traversing both coils and discharging to a common area, means for initiating and for terminating the defrosting of the evaporator requiring defrosting, said initiating means comprising means for reversing the refrigeration cycle thereby causing the evaporator to function as a condenser and the condenser as an evaporator, said initiating means also including means for stopping flow of air over the evaporator to be defrosted, the means for terminating the defrost including means for sensing when defrost is complete and means for delaying termination by re-reversal of the refrigeration cycle and restoring airflow over the evaporator after defrost is complete until attainment of specified suction superheat of the non-defrosting coil.

7. A dehumidification apparatus employing a reverse cycle compression type refrigeration system having an evaporator coil and a condenser coil, the coils being connected to exchangeably perform their functions, said evaporator periodically requiring defrosting, the apparatus including fan means for providing an airstream traversing both coils and discharging to a common area, means for reversing the refrigeration cycle thereby causing the evaporator to function as a condenser and causing defrosting of the frosted evaporator and for stopping airflow over the defrosting coil, and means for sensing when defrost is complete and means for delaying re-reversal of the refrigeration cycle and restoration of air flow over the evaporator after defrost is complete until elapse of a set time after defrost completion.

8. A dehumidification apparatus employing a reverse cycle compression type refrigeration system having an a first coil functioning as a frosting air cooling and dehumidifying evaporator and a second coil functioning as a condenser, the coils being connected to exchangeably perform their functions, the apparatus including fan means for providing an air stream discharging to a common area, the coils both being positioned in the air stream thereby both heating and cooling and dehumidifying said airstream, the airstream having a first velocity through each coil while functioning as an evaporator and a second velocity through each while functioning as a condenser, means for defrosting the evaporator coil requiring defrosting including means for reversing the refrigeration cycle, thereby causing the frosted then evaporator coil to function as a condenser and the then condenser coil as an evaporator, and further providing that the former condenser coil, now functioning as an evaporator, accumulates frost; means for stopping the air flow over the defrosting evaporator coil for the duration of the defrost and means for restoring the airflow over the defrosted evaporator after defrost is complete and thereafter reversing the cycle only when the newly frosting evaporator coil requires defrosting, thereby providing substantially continuous dehumidification and heating to the airstream.

9. A dehumidification apparatus as recited in claim 8, further providing that the air flow control means includes dampers.

10. A dehumidification apparatus as recited in claim 8, further providing separate fan means for each coil and that fan speed control comprises the airflow control means.

11. A dehumidification apparatus employing a reverse cycle compression type refrigeration system having a first coil and a second coil, the coils being connected to exchangeably perform their functions, the apparatus having two operating modes, a first mode during which the first coil acts as a cooling, dehumidifying and frosting evaporator and the second coil functions as a defrosting evaporator and subsequently as a condenser; and a second mode during which the first coil functions as a defrosting evaporator and subsequently as a condenser and the second coil functions as a cooling, dehumidifying and frosting evaporator; fan means for providing an air stream discharging to a common area, the coils both being positioned in the air stream, whereby the airstream is simultaneously heated and cooled and dehumidified; means for providing a first velocity through the coil functioning as an evaporator and a second velocity through the coil functioning as a condenser; means for changing from the first mode to the second mode only when the first coil requires defrosting and from the second mode to the first mode only when the second coil requires defrosting; and means functioning in both operating modes for establishing the first air velocity over the coil performing the function of an evaporator and for temporarily stopping the air flow and then establishing the second air velocity over the coil performing the function of a condenser.

* * * * *